US012391437B2

(12) United States Patent
Prinz et al.

(10) Patent No.: US 12,391,437 B2
(45) Date of Patent: Aug. 19, 2025

(54) SUCTION LANCE

(71) Applicant: elobau Gmbh & Co. KG, Leutkirch (DE)

(72) Inventors: Michael Prinz, Leutkirch (DE); Nadine Hildebrand, Leutkirch (DE)

(73) Assignee: LOBAU GMBH & CO. KG, Leutkirch (DE)

( * ) Notice: Subject to any disclaimer, the term of this patent is extended or adjusted under 35 U.S.C. 154(b) by 273 days.

(21) Appl. No.: 18/093,983

(22) Filed: Jan. 6, 2023

(65) Prior Publication Data

US 2023/0312190 A1 Oct. 5, 2023

(30) Foreign Application Priority Data

Jan. 10, 2022 (DE) ..... 10 2022 100 407.4
Aug. 12, 2022 (DE) ..... 20 2022 104 599.2

(51) Int. Cl.
*B65D 47/06* (2006.01)

(52) U.S. Cl.
CPC ..... *B65D 47/06* (2013.01)

(58) Field of Classification Search
CPC ..... B65D 47/06
USPC ..... 222/514; 16/2.3, 2.4
See application file for complete search history.

(56) References Cited

U.S. PATENT DOCUMENTS 1,577,539 A * 3/1926 Polk ..... G01F 11/084 215/309
1,966,384 A * 7/1934 Gabel ..... B67D 3/04 217/111
2,048,031 A * 7/1936 Rice ..... B65D 39/082 217/113
2,081,131 A * 5/1937 Joh ..... B67D 1/0829 222/545
2,646,293 A * 7/1953 Gray ..... B65D 39/082 222/400.7
2,728,491 A * 12/1955 Aneshansley ..... G01N 1/14 222/215

(Continued)

FOREIGN PATENT DOCUMENTS

DE 1815006 A1 7/1970
DE 2343232 A1 3/1975
DE 102019102033 A1 7/2020

OTHER PUBLICATIONS

European Search Report for European Patent Application No. EP22217087 mailed May 31, 2023 (1 page).

*Primary Examiner* — Paul R Durand
*Assistant Examiner* — Michael J. Melaragno
(74) *Attorney, Agent, or Firm* — Dickinson Wright PLLC

(57) ABSTRACT

A suction lance comprising at least one tube and a guide body made from an elastomer material axially displaceable on this tube is provided. The suction lance comprises a retaining section for a connecting body, a conical section axially adjoining the retaining section, the radially largest section whereof lies axially closer to the retaining section than the radially smallest section thereof, and a connecting body for the detachable connection of the suction lance to a removal opening of a container. The connecting body is fastened to the retaining section of the guide body, and the conical section of the guide body, by reason of its material, its radial size and the shape of its external contour, is designed to act in case of use as a sealing body in a removal opening of a container.

12 Claims, 4 Drawing Sheets

(56) References Cited

U.S. PATENT DOCUMENTS 2,768,771 A * 10/1956 Beutel ..... B67D 1/0456 222/464.2
2,845,203 A * 7/1958 Potash ..... B65D 83/425 222/402.18
2,897,533 A * 8/1959 Bull ..... B60R 16/0222 277/606
2,907,489 A * 10/1959 Taylor, III ..... B65D 47/148 222/569
3,240,392 A * 3/1966 Nicko ..... B67D 1/0829 285/364
3,343,699 A * 9/1967 Nicko ..... B67D 1/0829 222/400.7
3,545,475 A * 12/1970 Johnson, Jr. ..... B67D 1/0829 137/212
3,945,529 A * 3/1976 Haag ..... B65D 51/20 220/254.1
4,041,241 A * 8/1977 Olmstead ..... H02G 3/088 277/627
4,572,390 A * 2/1986 Grittmann ..... B65D 39/08 217/111
4,700,861 A * 10/1987 Neward ..... B67D 3/0048 141/46
4,969,565 A * 11/1990 Justal ..... A61J 15/0026 215/250
4,993,573 A * 2/1991 Freidel ..... B01L 3/565 215/276
5,353,472 A * 10/1994 Benda ..... F16L 5/10 16/2.2
5,732,440 A * 3/1998 Wright ..... H02G 3/083 16/2.2
5,924,585 A * 7/1999 Henderson ..... B67D 7/0288 215/319
6,062,440 A * 5/2000 Murray ..... A01K 7/06 222/542
6,345,741 B1 * 2/2002 Murray ..... A01K 7/06 222/542
6,684,814 B1 * 2/2004 Ver Hage ..... A01K 7/06 119/72
7,604,147 B2 * 10/2009 Anderson ..... B67D 1/0462 222/105
8,690,161 B2 * 4/2014 Cayzac ..... F16L 5/10 277/606
9,527,631 B2 * 12/2016 Grittmann ..... B65D 39/12
2003/0097994 A1 * 5/2003 Ver Hage ..... A01K 7/06 119/72
2010/0133227 A1 * 6/2010 Ver Hage ..... A01K 39/0213 215/354
2015/0108080 A1 * 4/2015 Grittmann ..... B65D 45/32 215/359

* cited by examiner

SUCTION LANCE

This U.S. patent application claims priority to German patent application no. 10 2022 100 407.4, filed Jan. 10, 2022, and German utility model patent application no. 20 2022 104 599.2, filed Aug. 12, 2022, the entire contents of which are incorporated herein by reference in their entirety.

BACKGROUND

1. Technical Field

The present invention relates to a suction lance.

2. Related Art

Suction lances are used for the removal of liquids (fluid media) from containers, in particular fuels, operating resources, agents for the reduction of exhaust gas constituents, disinfection and cleaning agents and other fluid media. They can be fastened reversibly to a container.

Suction lances as a rule comprise a head part fastened in the operating state to the outer side of the container and one or more tubes projecting into the container and thus into the fluid media (liquid) and conducting medium in the operating state, which are held as applicable in a foot part. The foot part can stand on the bottom of the container, but often hangs freely in the container and has no contact with the bottom thereof or is completely absent. Insofar as present, it comprises one or more inlet openings for the fluid, so that the latter can penetrate into the tube or tubes and can be passed through the latter. The tubes are connected media-tight to the foot and head part, wherein a second tube possibly present serves as a return line. Suction lances can also comprise a float or in general a sensor, by means of which the liquid level in the container or other properties of the liquid such as its temperature, etc. can be detected. The head part usually has connections for the onward transfer of the liquid removed from the container (the removed fluid medium) to downline pump metering systems.

Suction lances are intended to enable a reliable removal of the fluid medium present in the container. This applies in particular when the container changes in its spatial orientation during the removal, in particular is tilted or placed upside down or subjected to vibrations or is shaken.

Different containers comprise the most varied connection options at their respective removal openings, for example a nozzle with an external thread or one with a smooth wall. In addition, the diameter of the respective removal openings differ from one another with different containers.

Suction lances are thus known from the prior art which are designed for containers with specific connection arrangements and cannot be assembled operationally reliable on containers with other connection arrangements.

DE 10 2019 102 033 A1 discloses a suction lance, in which a tube is housed in a sleeve element made of a rigid material which is displaceable thereon, which for its part passes through a coaxial opening of a cap cover with an inner retaining contour, wherein the cap cover with the retaining contour can be screwed/pushed onto an external thread of a container opening in the manner of an internal thread and the snap-in projections of the retaining contour engage into the external thread of the container. For this purpose, this known cap cover is formed from an elastically deformable material. It also comprises a vent opening. By replacing a cap cover for another one, this suction lance can be adapted to different containers.

SUMMARY

The invention has the problem of specifying a suction lance which can be fastened in a straightforward manner to different containers.

This problem is solved by a suction lance, comprising at least one tube and a guide body made from an elastomer material axially displaceable on this tube, comprising a retaining section for a connecting body, further comprising a conical section axially adjoining the retaining section, the radially largest section whereof lies axially closer to the retaining section than the radially smallest section thereof, further comprising a connecting body for the detachable connection of the suction lance to a removal opening of a container, wherein the connecting body is fastened to the retaining section of the guide body, wherein the conical section of the guide body, by reason of its material, its radial size and the shape of its external contour, is designed to act in case of use as a sealing body in a removal opening of the container.

To great advantage, the invention enables the use of the guide body of the tube at the same time also as a sealing body at a removal opening of the container and thus very advantageously extends the types of container for which the suction lance according to the invention can be used. The latter can be fastened to the container both by different connection bodies and also by the guide body itself. According to the invention, therefore, both these two bodies are available in each case alone for the fastening as well as jointly, which leads to a particularly operationally reliable fastening of the suction lance to the container.

For this purpose, the guide body is in the first place formed from an elastomer, soft material deformable with little effort, which can abut in a sealing manner against the inner wall or the edge of a removal opening. In addition, the guide body is constituted with a conical section with in particular a smooth outer contour in the manner of a lateral surface of a truncated cone, which thus provides different diameters for sealing along its axial extension, as a result of which both narrow and also further removal openings up to the maximum radial size of the conical section can be closed in a sealing manner with this guide body.

The possibility according to the invention of being able to fasten the suction lance both by means of the connecting body at the outer side of the removal opening and also by the conical section at the inner side is a particularly great advantage.

In an embodiment of the invention, provision is made such that, in its interior, the guide body comprises two retaining collars axially spaced apart from one another for contact with the tube, in particular retaining collars which are adapted to the outer contour of a rounded rectangular tube. These retaining collars serve to guide the tube and seal its outer side, so that any fluid creeping along there cannot escape to the outside and thus to the user of the suction lance.

In a development of the invention, provision is made to particularly great advantage that the retaining section is constituted roughly u-shaped in the cross section of the guide body, wherein the base of the U lies radially inwards relative to the radially largest section of the conical section. This enables a particularly reliable and firm connection between the guide and connecting body, since the latter is encompassed by the legs of the U.

In an embodiment of the invention, provision is made such that a first end of the guide body is formed by one of the two retaining collars and a second end of the guide body lying axially opposite is formed by a gripping and displacement collar, which is constituted in particular radially larger than the radially largest section of the conical section of the guide body and which preferably comprises a radial recess, in such a way that an accommodation for a welding seam on the tube is formed. The gripping collar enables the axial movement of the guide body along the longitudinal axis of the tube accommodating it by a simple grip. The axially running radial recess forms an accommodation open at one side at the second end of the guide body, so that the latter as it were can be pushed up to the stop at the end of the tube, where the latter is usually connected to further components of the suction lance by means of an, in particular, bulge-like welding seam or a connection piece, as explained at the outset. This in turn enables a particularly deep immersion of the tube into the container, since the components of the suction lance according to the invention serving for the fastening to the container are arranged virtually completely at the end of the tube.

If a retaining collar comprises one or more radially inwardly springing sealing lips and/or an axial groove, in particular a venting groove, a particularly tight contact at the outer wall of the tube is very advantageously enabled, so that no fluid can escape that is creeping along the tube. A venting groove admittedly prevents this function, but advantageously permits a structurally simple ventilation, that is to say a simple compensation for the removed liquid volume by external air flowing into the container.

In a development of the invention, provision is made such that the guide body comprises a connecting nozzle for the media return flow or for the container venting. This alternative to the venting groove is preferred, since both the tube is thus sealed and also a volume compensation is enabled.

In an embodiment of the invention, provision is made such that the guide body is formed from one of the materials of the group formed by silicon, EPDM, TPE, TPU, FKM, NBR, rubber, natural rubber, and/or have a Shore-A hardness between 40 and 60, limits included. These materials are particularly well suited in order on the one hand to enable the sealing function of the guide body desired according to the invention and are also particularly resistant or inert with respect to the fluid/media to be removed.

In particular, the guide body is constituted as a hollow body, in the hollow space whereof at least one retaining collar is constituted axially projecting. A hollow body is again better suited for performing a sealing function on account of its deformability.

Finally, provision is also made in an embodiment of the invention such that the connecting body is a screw cover, a snap-on cover, a snap-on cap or a disc-like insert. The invention very advantageously enables a replacement of a connecting body by one of the others stated, which are all fastened to the retaining section. This retaining section is constituted such that this cover/cap can be pulled onto the guide body without dismantling any float of the suction lance that might be present.

In a development of the suction lance, provision is made such that the guide body has an elliptical cross-section, in particular over the axial length of the conical section. Such an elliptical cross-section of the conical section, especially between its largest and smallest radial extension, displays a better clamping behaviour with a simultaneously facilitated introduction into the opening of the container. This elliptical cross-section is deformed into a round cross-section by pressing in and thus reliably abuts against the opening wall. In other words, an improved clamping behaviour thus results with markedly reduced insertion force.

The development is particularly advantageous, according to which the radially largest section of the conical section comprises a thickening. This additional thickening again improves the retaining force in the elliptical region and facilitates the insertion. The connecting body according to the invention such as a screw cover, a snap-on cover, a snap-on cap or an insert can easily be pushed over this thickening and thus held better in the retaining section of the guide body. In an embodiment of the invention, this retaining section is also itself constituted with an elliptical cross-section.

If a recess is provided in the displacement collar for the ventilation, good aeration and venting of the container is thus guaranteed in a straightforward manner.

BRIEF DESCRIPTION OF THE DRAWINGS

The invention is explained in greater detail below with the aid of the figures of the drawing, wherein identical components are provided with the same reference numbers. In the figures.

DETAILED DESCRIPTION OF EXAMPLE EMBODIMENTS

Figure 1A:
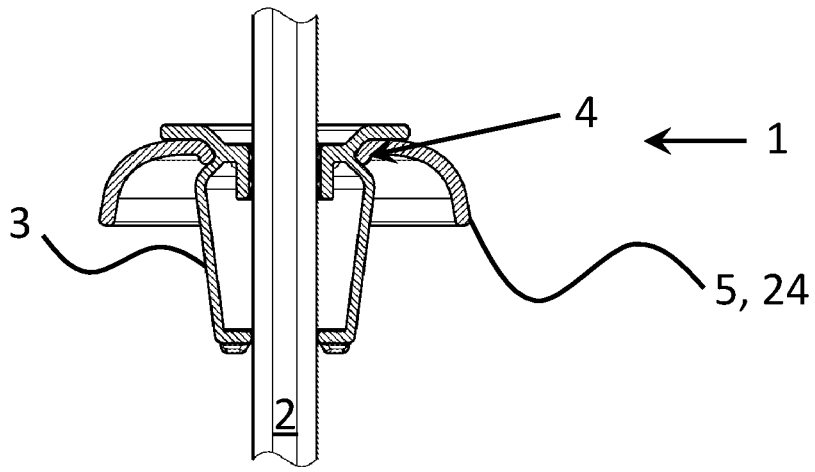
FIGS. 1A, 1B and 1C are partial figures each showing a diagrammatic cross-section through part of an embodiment of the suction lance with different connecting bodies.
Figure 1B:
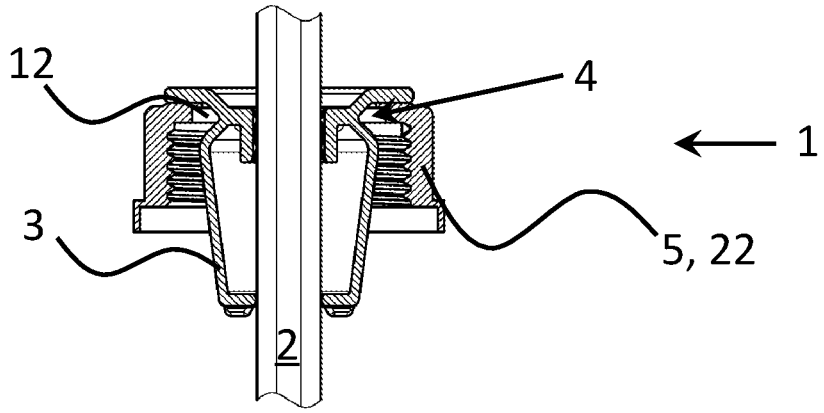
Figure 1C:
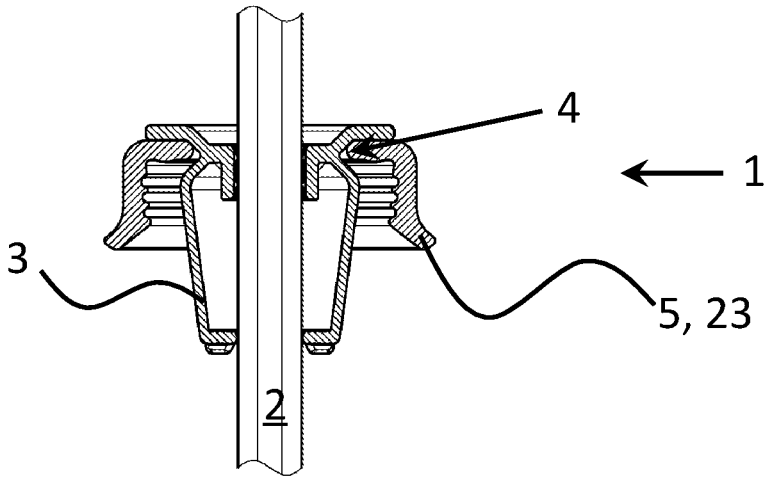

FIG. 1A is an axial partial section of an embodiment of suction lance 1 with tube 2, which is accommodated in a guide body 3. A connecting body 5 is fastened in a retaining section 4, which here is constituted as a snap-on cap 24 and is snapped onto a nozzle in a removal opening of a container. In the same way, partial FIG. 1B shows a connecting body 5 as a screw cover 22, which is screwed onto an external thread of a removal opening of a container and partial FIG. 1C shows a connecting body 5 as a snap-on cover 24, which is clipped onto a nozzle on a removal opening of a container.

On account of the embodiment of retaining section 4 as a roughly u-shaped region lying in cross-section, the latter offers fastening and holding possibilities for different connecting bodies 5. Thus, the snap-on cap 24 usually made of flexible, in particular rubbery material, clamps with its rounded end against both sides of the U, whereas the other two connecting bodies 5 either compress the base of the U 12 together and/or widen the sides of the U, so that the latter press against it on account of their material properties and thus hold it in a force-fit and also a slightly form-fit manner. Since, as will be described further below, guide body 3 can itself also function according to the invention as a sealing body in a removal opening, a coloured insert in the form of a disc penetrated by guide body 3 is also a form of a connecting body according to the invention, even if this insert does not produce any connection to a container. By selecting the colour, however, it can indicate the contents of a container in a rapidly detectable manner.

Figure 2A:
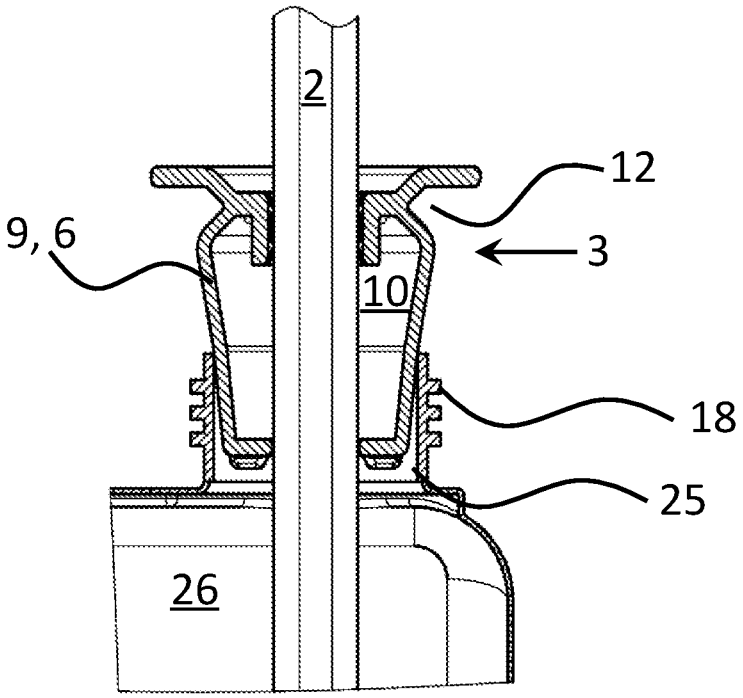
FIGS. 2A and 2B are partial figures each showing an arrangement of the embodiment in two removal openings of differing width.

FIG. 2A shows an arrangement of a guide body 3 according to the invention in a removal opening 25 of a container 26, wherein removal opening is understood to mean the actual opening as well as associated nozzle 18 with an external thread. Connecting body 5 has been omitted in this representation. With the represented arrangement, guide body 3, by means of its outer contour 9—a truncated cone lateral surface, seals at the edge of the neck of container 26 on account of its elastomer material, its shape and its axial extension with its conical section 6. As can easily be seen, this kind of seal is possible for all removal openings 25 which have an opening diameter smaller than or equal to the different diameters of conical section 6. In combination with a snap-on cap 24 according to FIG. 1A as a connecting body 5, the otherwise usual equipment of the suction lance with additional weight against floating can thus advantageously be dispensed with, and also no fluid can run out when the container tilts. In other words, only the elastomer, large-diameter and conically running guide body according to the invention enables a reliable and simple use of snap-on caps as connecting bodies and with removal openings of differing width.

Figure 2B:
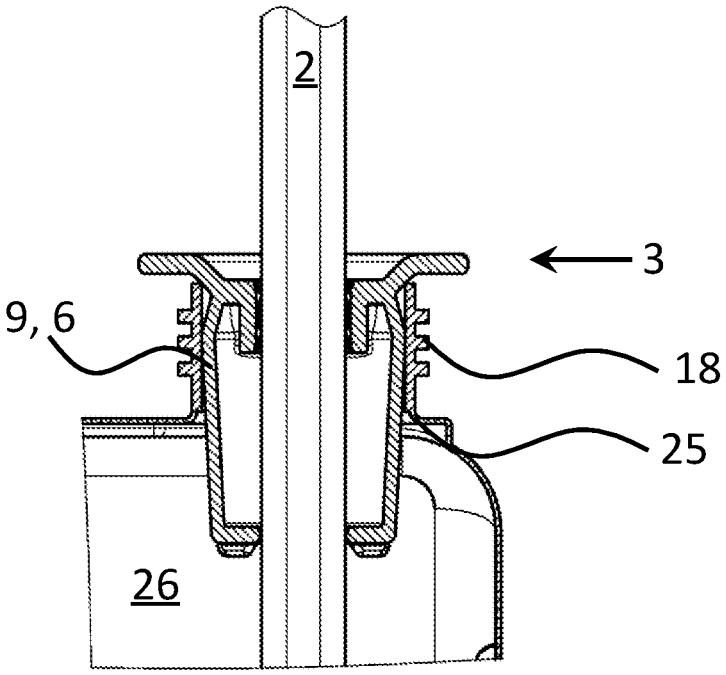

Soft, elastomer guide body 3 can also be arranged in this clamping and sealing manner with very large opening widths of a removal opening 25, as partial FIG. 2B shows. Here, it is not the truncated cone lateral surface or conical section 6 that are compressed, but the base of the truncated cone itself. On account of the large contact area, this represents a particularly tight and firm connection of suction lance and container.

The arrangements according to these two partial figures enable in each case a double connection between suction lance and container, i.e. simultaneously by connecting body 5 and guide body 3 not represented for the sake of clarity.

Figure 3A:
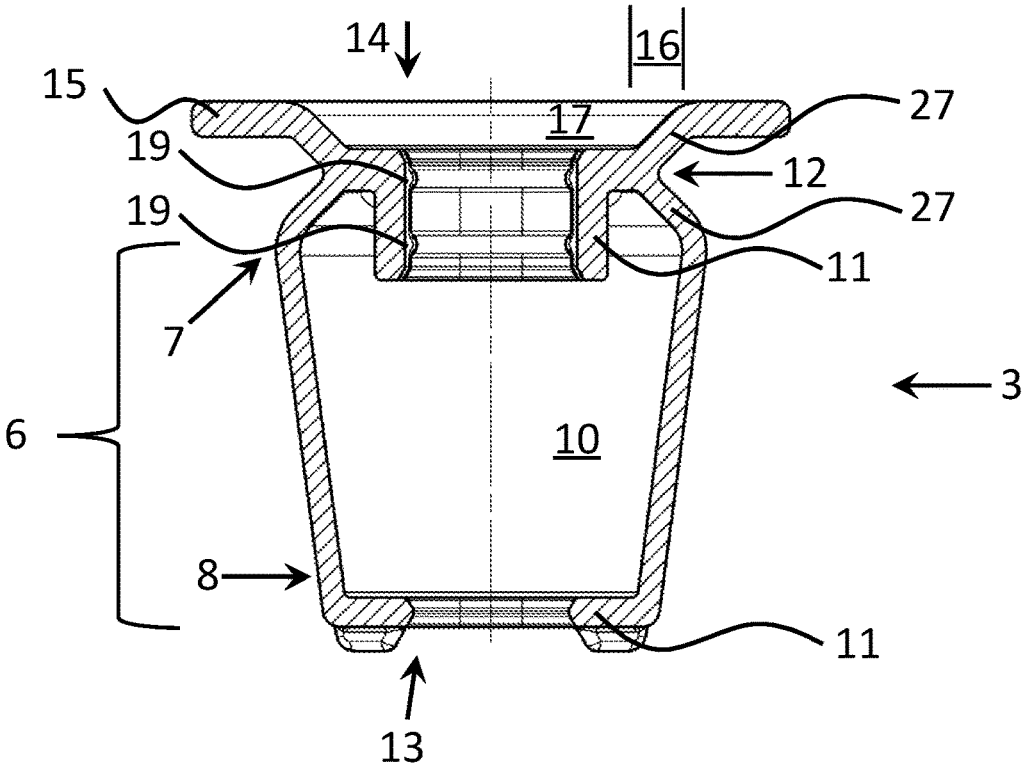
FIG. 3A is a side view through a guide body of a first embodiment and FIG. 3B is a perspective cross-sectional view through a guide body of a second embodiment.

FIG. 3A shows a cross-sectional view through a first embodiment of a guide body 3 according to the invention. The latter is constituted as a hollow body with an interior 10, through which tube 2 not represented here penetrates. This tube is axially spaced apart at two retaining collars 11, of which one is arranged at first end 13 of guide body 3 and which also serves for the stabilisation of the tube guidance. Second retaining collar 11 comprises two sealing lips 19, which abut against the external wall of the tube and prevent fluid from leaking out between the tube and the guide body. A possibly present axial groove penetrating through the two sealing lips 19 serves for the ventilation of the container interior and thus facilitates the removal of liquid, even though the fluid density is somewhat reduced as a result. The passage opening area of the two retaining collars 11 is constituted in this embodiment as a rounded rectangle and is therefore suited for rectangular tubes, as can be seen in particular from partial FIG. 3B. Other passage opening areas are also according to the invention, in particular circular or oval, depending on the nature of the tube.

Retaining collar 11 lying in the direction of second end 14 transforms on the one hand into a displacement collar 15, at which the relative axial position of guide body 3 to a tube can be changed. On account of the soft material of guide body 3, a frequent axial adjustment is possible, without it no longer abutting firmly against the tube due to wear. This is in particular the case with the known guide bodies made of a hard material such as PVC, which permit only very few axial position changes. With the latter, inevitable hard mounting of the connecting body rapidly wears away, so that the latter can no longer be connected firmly to the hard guide bodies.

The base of the U 12 and sides 27 branching off from the latter serve to clamp a connecting body, just as the base of the U 12 itself, as previously described.

At second end 14, the displacement collar 15 springs radially inwards in such a way that an axially-radially running accommodation 17 is formed, in particular a conical one, in which for example a welding seam at the end of the tube can be housed, so that the tube can be arranged as deeply as possible in the container, since it is supported at its upper end as far as possible.

The outer contour of guide body 3 with its conical section 6 and radially largest section 7 as well as radially smallest section 8 can clearly be seen.

Figure 3B:
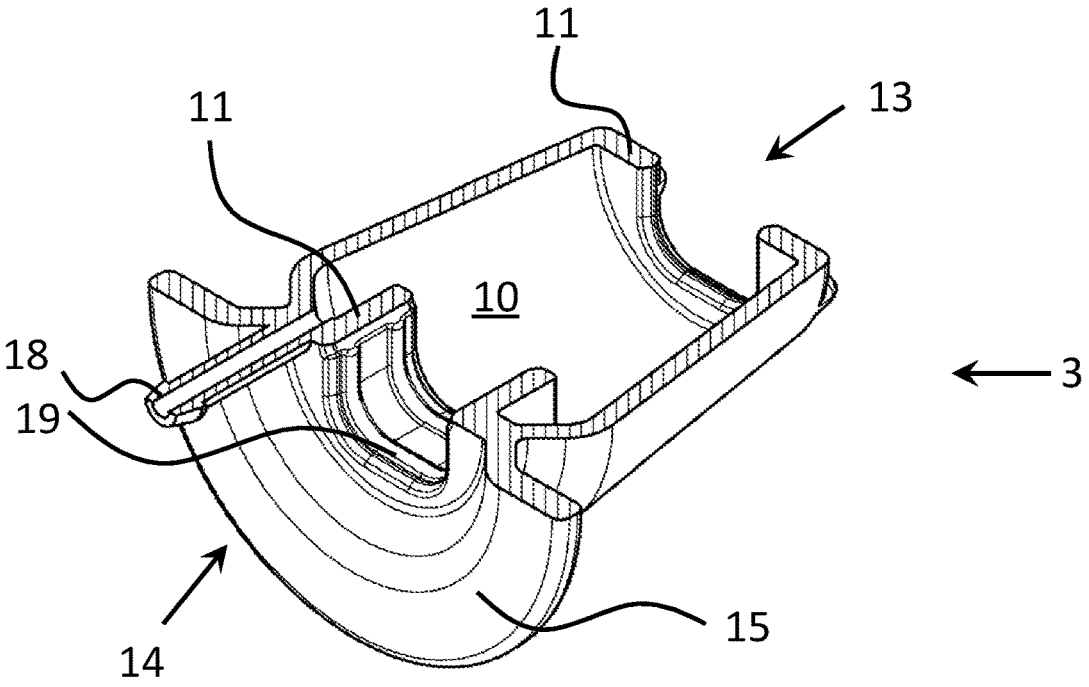

Partial FIG. 3B shows a perspective cross-sectional view of a second embodiment, in which in particular a connecting nozzle 18 for the ventilation is provided, so that upper retaining collar 11 abuts against the tube wall in a completely sealing manner. According to the invention, this connecting nozzle 18 can also be used for the return flow of removed fluid into the container.

Very advantageously, the invention of a guide body made of elastomer material such as silicon, EPDM, TPE, TPU, FKM, NBR, rubber, natural rubber, which have a Shore-A hardness between 40 and 60, in a conical shape with a smooth outer contour, or outer surface with the provision of a many-sided retaining section for different connecting bodies, permits a suction lance which is suitable for use with very different containers with removal openings of different sizes and shapes. The complicated adjustment of the insertion depth of the suction lance by for example clamping rings and nuts can advantageously be dispensed with, since the described connecting body can be displaced axially in an easy and durable manner and in addition also undertakes a sealing and retention function for the suction lance.

Figure 4B:
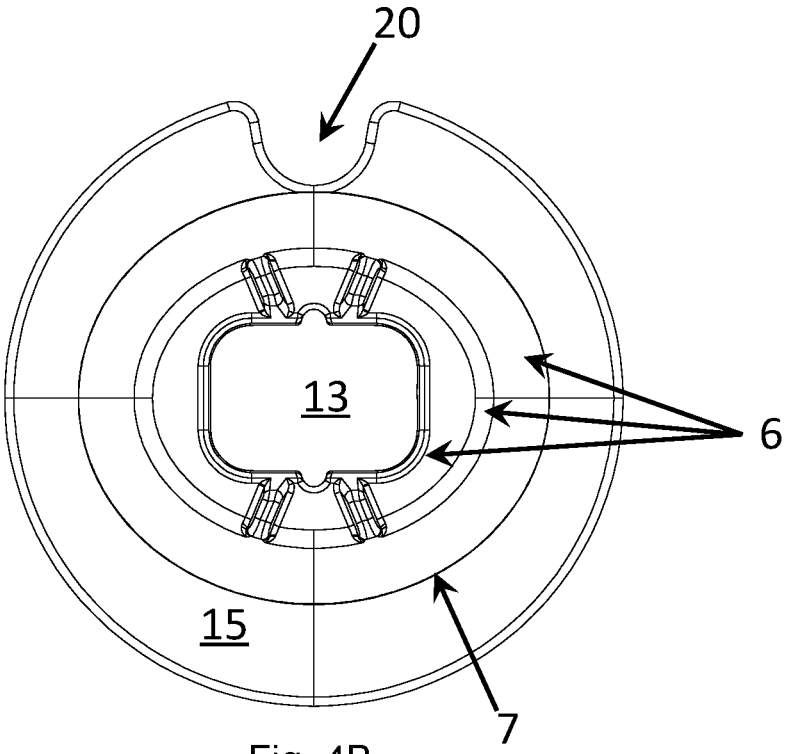
FIG. 4B is a perspective view of the embodiment of the guide body with the elliptical cross-section of the conical section.
Figure 4A:
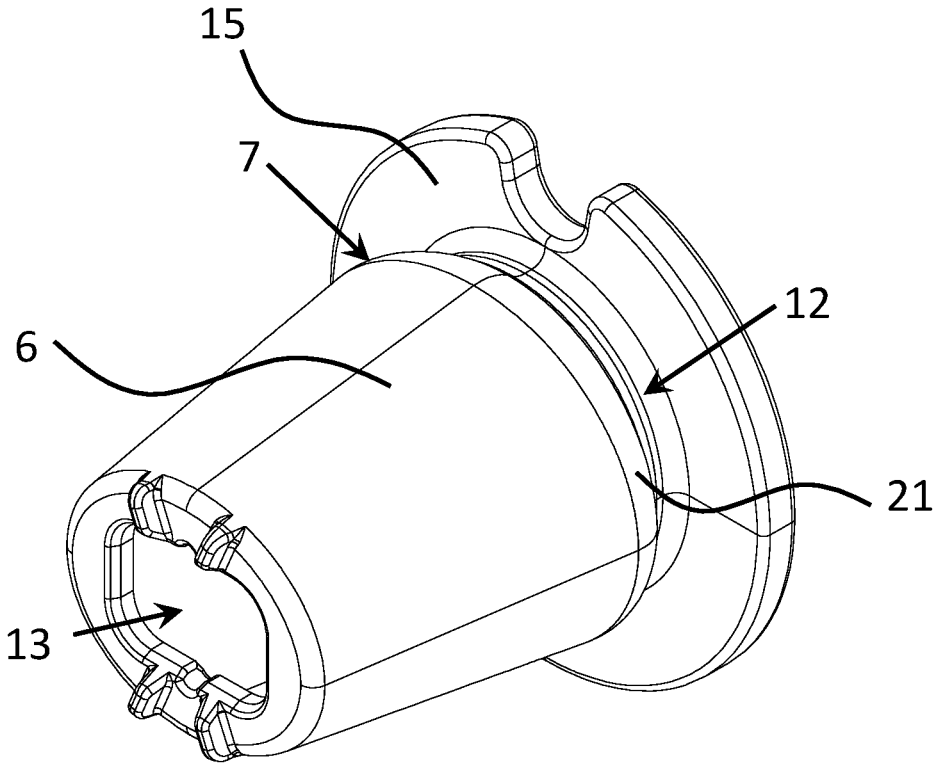
FIG. 4A is a side view of an embodiment of a guide body with an elliptical cross-section of the conical section.

FIGS. 4A and 4B show a further embodiment of guide body 3, wherein conical section 6 has an elliptical cross-section, in particular between its radially largest section 7 and its radially smallest section 8. This leads to an easier insertability of the suction lance into a removal opening 25 (see FIG. 2A) of a container, since contact with its inner wall over the greatest part of the circumference is avoided and can only take place in the region of the main axis. According to the invention, an elliptical cross-section can also be understood to mean an oval cross-section. The elliptical cross-section extends in this embodiment not up to displacement collar 15, but is connected to the latter via an axial section of guide body 3, which has a circular cross-section. In partial FIG. 4A, a thickening 21 can also be seen, which is arranged in radially largest section 7.

In partial FIG. 4B, it can be seen that a recess 20 is provided in displacement collar 15 for the ventilation of a container. Such a recess represents the simplest possibility for such ventilation.

The invention claimed is:

1. A suction lance, comprising:

at least one tube and a guide body made from an elastomer material axially displaceable on the tube, a retaining section for a connecting body, the connecting body being for a detachable connection of the suction lance to a removal opening of a container, a conical section axially adjoining the retaining section, the radially largest section whereof lies axially closer to the retaining section than the radially smallest section thereof, wherein the connecting body is fastened to the retaining section of the guide body, wherein the conical section of the guide body, by reason of its material, its radial size and the shape of its external contour, is designed to act in case of use as a sealing body in a removal opening of a container, wherein in its interior, the guide body comprises two retaining collars axially spaced apart from one another for contact with the tube, in particular retaining collars which are adapted to the outer contour of a rounded rectangular tube.

2. A suction lance, comprising:

at least one tube and a guide body made from an elastomer material axially displaceable on the tube, a retaining section for a connecting body, the connecting body being for a detachable connection of the suction lance to a removal opening of a container, a conical section axially adjoining the retaining section, the radially largest section whereof lies axially closer to the retaining section than the radially smallest section thereof, wherein the connecting body is fastened to the retaining section of the guide body, wherein the conical section of the guide body, by reason of its material, its radial size and the shape of its external contour, is designed to act in case of use as a sealing body in a removal opening of a container, wherein the guide body comprises two retaining collars axially spaced apart from one another, wherein a first end of the guide body is formed by one of the retaining collars and a second end of the guide body lying axially opposite is formed by a gripping and displacement collar, which is constituted in particular radially larger than the radially largest section of the conical section of the guide body and which comprises a radial recess, in such a way that an accommodation for a welding seam on the tube is formed.

3. A suction lance, comprising:

at least one tube and a guide body made from an elastomer material axially displaceable on the tube, a retaining section for a connecting body, the connecting body being for a detachable connection of the suction lance to a removal opening of a container, a conical section axially adjoining the retaining section, the radially largest section whereof lies axially closer to the retaining section than the radially smallest section thereof, wherein the connecting body is fastened to the retaining section of the guide body, wherein the conical section of the guide body, by reason of its material, its radial size and the shape of its external contour, is designed to act in case of use as a sealing body in a removal opening of a container, wherein the guide body comprises a connecting nozzle for a media return flow or for the container venting.

4. A suction lance, comprising:

at least one tube and a guide body made from an elastomer material axially displaceable on the tube, a retaining section for a connecting body, the connecting body being for a detachable connection of the suction lance to a removal opening of a container, a conical section axially adjoining the retaining section, the radially largest section whereof lies axially closer to the retaining section than the radially smallest section thereof, wherein the connecting body is fastened to the retaining section of the guide body, wherein the conical section of the guide body, by reason of its material, its radial size and the shape of its external contour, is designed to act in case of use as a sealing body in a removal opening of a container, wherein an end of the guide body is formed by a displacement collar, and wherein a recess is provided in the displacement collar for ventilation.

5. A suction lance, comprising:

at least one tube and a guide body made from an elastomer material axially displaceable on the tube, a retaining section for a connecting body, the connecting body being for a detachable connection of the suction lance to a removal opening of a container, a conical section axially adjoining the retaining section, the radially largest section whereof lies axially closer to the retaining section than the radially smallest section thereof, wherein the connecting body is fastened to the retaining section of the guide body, wherein the conical section of the guide body, by reason of its material, its radial size and the shape of its external contour, is designed to act in case of use as a sealing body in a removal opening of a container, thereby having a radial sealing function, and whereby the suction lance can be fastened to the container by the guide body itself.

6. The suction lance according to claim 5, wherein the retaining section is constituted roughly u-shaped in the cross section of the guide body, wherein the base of the U lies radially inwards relative to the radially largest section of the conical section.

7. The suction lance according to claim 5, wherein a retaining collar comprises one or more radially inwardly springing sealing lips and/or an axial groove, in particular a venting groove.

8. The suction lance according to claim 5, wherein the guide body is formed from one of the materials of the group silicon, EPDM, TPE, TPU, FKM, NBR, rubber, natural rubber, and/or has a Shore-A hardness between 40 and 60, limits included.

9. The suction lance according to claim 5, wherein the guide body is constituted as a hollow body, in the interior whereof at least one retaining collar is constituted axially projecting.

10. The suction lance according to claim 5, wherein the connecting body is a screw cover, a snap-on cover, a snap-on cap or a disc-like insert.

11. The suction lance according to claim 5, wherein the guide body has an elliptical cross-section over the axial length of the conical section.

12. The suction lance according to claim 5, wherein the radially largest section of the conical section has a thickening.

* * * * *